US007905748B2

(12) United States Patent
Benke

(10) Patent No.: US 7,905,748 B2
(45) Date of Patent: Mar. 15, 2011

(54) TEMPORARY CONNECT

(76) Inventor: James Benke, Helotes, TX (US)

( * ) Notice: Subject to any disclaimer, the term of this patent is extended or adjusted under 35 U.S.C. 154(b) by 35 days.

(21) Appl. No.: 12/357,568

(22) Filed: Jan. 22, 2009

(65) Prior Publication Data

US 2009/0247016 A1 Oct. 1, 2009

Related U.S. Application Data

(60) Provisional application No. 61/070,825, filed on Mar. 26, 2008.

(51) Int. Cl.
*H01R 33/945* (2006.01)

(52) U.S. Cl. ..... 439/517; 361/641

(58) Field of Classification Search ..... 439/146, 439/167, 517; 361/641, 659
See application file for complete search history.

(56) References Cited

U.S. PATENT DOCUMENTS

| | | | | | |
|---|---|---|---|---|---|
| 4,944,692 | A * | 7/1990 | Allina | 439/517 |
| 5,097,383 | A | 3/1992 | Heard et al. | |
| 5,129,841 | A * | 7/1992 | Allina et al. | 439/517 |
| 5,181,166 | A * | 1/1993 | Howell | 361/659 |
| 5,216,802 | A | 6/1993 | Cole et al. | |
| 5,315,475 | A | 5/1994 | Scheidel et al. | |
| 5,400,212 | A | 3/1995 | Hanson | |
| 5,574,612 | A | 11/1996 | Pak | |
| 5,577,933 | A * | 11/1996 | Robinson et al. | 439/517 |
| 5,838,078 | A | 11/1998 | Tipton | |
| 6,015,314 | A * | 1/2000 | Benfante | 439/517 |
| 6,200,158 | B1 * | 3/2001 | Robinson | 439/517 |
| 6,956,733 | B2 | 10/2005 | Beasley, III et al. | |
| 7,209,331 | B2 | 4/2007 | Shoop | |
| 7,397,652 | B2 * | 7/2008 | Price et al. | 361/643 |
| 7,458,846 | B2 * | 12/2008 | Loehr et al. | 439/517 |
| 2004/0165340 | A1 | 8/2004 | Wilfong | |

* cited by examiner

*Primary Examiner* — Thanh-Tam T Le
(74) *Attorney, Agent, or Firm* — Sean C. Crandall; Jackson Walker LLP

(57) ABSTRACT

A temporary connect enables a structure to receive electrical power via a simple extension cord before a utility meter is installed. The temporary connect incorporates the form factor of a standard power meter and mounts to the meter cabinet. It includes a standard male connector or breaker, fuse or lug recessed within a base. A female end of an extension cord may be plugged into the male connector, and the opposite end may be plugged into a temporary meter pole or other power source. The temporary connect connects the prongs of the connector to the load leads of the meter cabinet, but isolates the connector and load prongs from the line leads. The structure thereby can easily receive power for testing the circuits, lights, and other devices. When construction is complete, the temporary connect can be easily removed and replaced with a permanent power meter.

16 Claims, 5 Drawing Sheets

TEMPORARY CONNECT

CROSS REFERENCE TO RELATED APPLICATIONS

This application claims the benefit of U.S. Provisional Application 61/070,825 filed Mar. 26, 2008.

BACKGROUND

1. Field of the Invention

This invention relates to providing electrical power to a structure under construction or other construction site and more particularly to a temporary connect for providing electricity to the completed wiring system of a structure via a common extension cord.

2. Description of Related Art

At a typical construction site, there is a temporary power source on site to provide electrical power for construction purposes. For example, a temporary power pole, including a temporary meter, may be used. When the project is close to completion, a permanent electrical meter loop configured to accept a permanent power connection is installed. On many locations this permanent power meter is not installed until construction is substantially complete. At that point, the utility company will install the power meter and make the final power connection.

Electricians who wish to test lights, circuits, or other electrical devices in the structure must sometimes wait until a permanent meter is installed, or find another means to temporarily power the structure.

SUMMARY OF THE INVENTION

Figure 1:
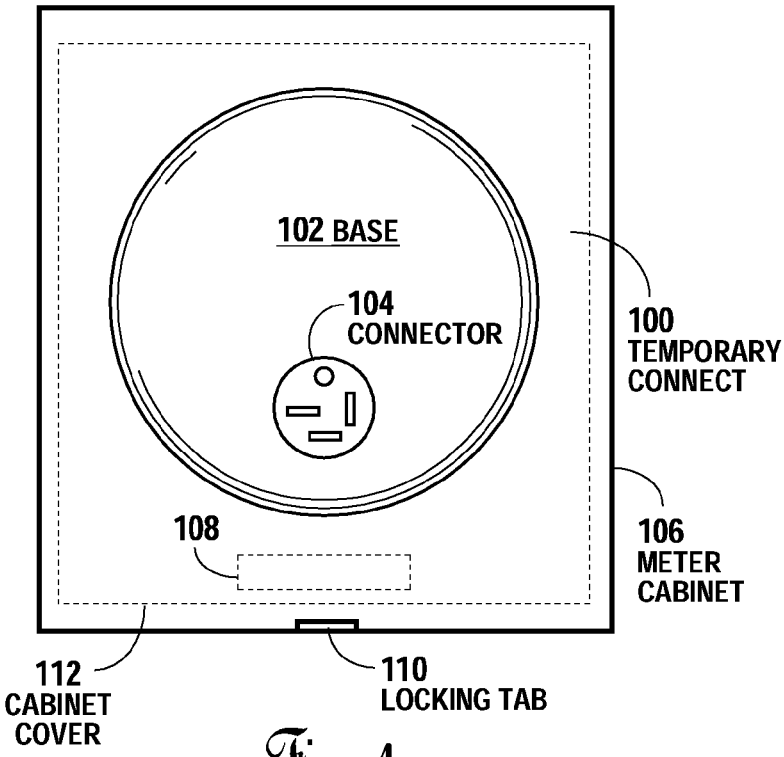
FIG. 1 is a front elevation view of a standard meter cabinet equipped with a temporary connect.

A temporary connect enables a structure to receive electrical power via a simple extension cord before a utility meter is installed. The temporary connect incorporates the form factor of a standard power meter and mounts to the meter cabinet. It includes a standard male connector or breaker, fuse or lug recessed within a base. A female end of an extension cord may be plugged into the male connector, and the opposite end may be plugged into a temporary meter pole or other power source. The temporary connect connects the prongs of the connector to the load leads of the meter cabinet, but isolates the connector and load prongs from the line leads. The structure thereby can easily receive power for testing the circuits, lights, and other devices. When construction is complete, the temporary connect can be easily removed and replaced with a permanent power meter.

In another aspect of this device, a breaker, fuse and/or lugs matched to the correct voltage and phase are used to provide the connection for the temporary connect. A breaker may be provided as an integral part of this device in any of its forms. The breaker may be interchangeable and the device may be adapted for use with any load.

DETAILED DESCRIPTION OF THE EMBODIMENTS

A temporary connect provides a simplified means of powering a structure or other construction site before construction is complete and a final permanent power connection is made. The temporary connect provides a connection point, such as a male connector, which it electrically couples to the load terminals, thereby providing power to the structure or site. It also electrically isolates the load terminals from the line terminals, thereby electrically insulating the site from the permanent power source. This allows power to be routed from a temporary power generator, temporary pole, or other source via a simple extension cord properly equipped with the appropriate NEMA electrical connector. Furthermore, a temporary connect may use the same form factor as a permanent power meter. Because of this novel configuration, a qualified electrician may make a safe connection to the meter cabinet at any time without a permanent power meter being provided.

By providing the ability to easily connect and disconnect power to the site, the temporary connect allows those working on the site to easily perform a number of tasks. For example, an electrician may test and balance circuits and ensure that the electrical system is working properly. With the electrical system tested, other work crews can perform their tasks. For example, an air conditioning system can be charged and tested. Lights, trim, dry wall and other interior work crews can use the temporary electrical power to operate their power tools, and lighting can be provided for night work. When the structure or site is finally complete, there is no need for the electrician to return to finally install the permanent power meter. Because of the modular design of the temporary connect, it has the same form factor as a permanent power meter. It can be ejected from the meter cabinet (without any need of specialized electrical training or tools) and replaced with the permanent power meter.

Another aspect of the present specification is an enhanced safety mechanism in the form of a safety release switch. A safety release switch can be provided either as part of the temporary connect or as part of the electrical connector. The safety release switch may be biased to an open or disconnected position and configured to release the electrical connection from the temporary connect whenever in the open position. When the front cover of the meter cabinet is closed, the safety released switch is engaged in a closed or connected position. This allows the temporary connect to be connectively seated within the meter cabinet and for the electrical connections to be complete. In this manner, it can be assured that the temporary connect will never energize the structure or site when the meter cabinet cover is off, thus providing for additional safety.

A temporary connect will now be described with more particular reference to the attached drawings.

FIG. 1 illustrates a meter cabinet 106 equipped with a temporary connect 100. The temporary connect 100 includes an electrical connector 104, which in some embodiments may be protected by an in-use weather proof cover (not shown). Electrical connector 104 may provide any multi-prong configuration, and in particular may be one of a number of NEMA standard connectors. In some embodiments, connector 104 will provide a configuration suitable for a 220-volt alternating current input. The electrical connector 104 is located within a base member 102. The electrical connector 104 may be a male adapter, breaker, lug, or fused device/connector, and may be recessed within base member 102. There is also shown a safety release switch 108 which is engaged in a closed position by a meter cabinet cover 112. Finally, there is shown a locking tab 110 which allows the meter cabinet to be locked.

Figure 2:
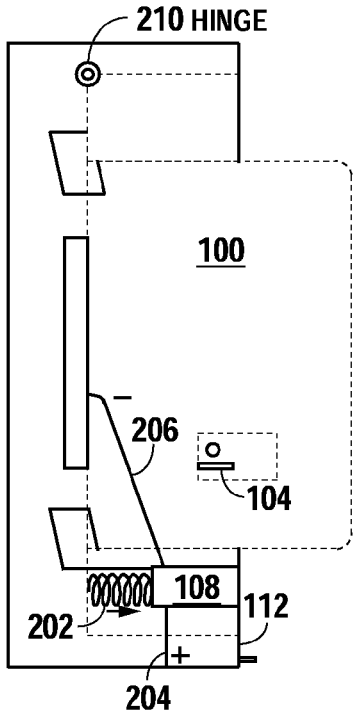
FIG. 2 is a cutaway side view of a standard meter cabinet equipped with a temporary connect, more particularly showing a safety release mechanism.

FIG. 2 shows a side view of a meter cabinet equipped with a temporary connect, more particularly showing the operation of the safety release switch 108. There can be seen in this view safety release switch 108 which may be biased in an open position by spring 202. There is also shown an exemplary circuit including positive node 204 and negative node 206. When safety release switch 108 is held in a closed position by meter cabinet cover 112, then positive node 204 and neutral node 206 are connected and the temporary connect 100 is operable to provide electrical power to the structure or site. When meter cabinet cover 112 is opened, safety release switch 108 is biased to an open position by spring 202, thereby breaking the connections between positive node 204 and negative node 206. This ensures that at any time, when the meter cabinet cover 112 is open, no power will be provided to the site.

In other embodiments, instead of a mechanical switch, other types of disconnect mechanisms may be used. For example, the switch may be a solid-state switch, a proximity switch, a relay, or any other mechanism adapted to disconnect power in the presence or absence of an input.

Figure 3:
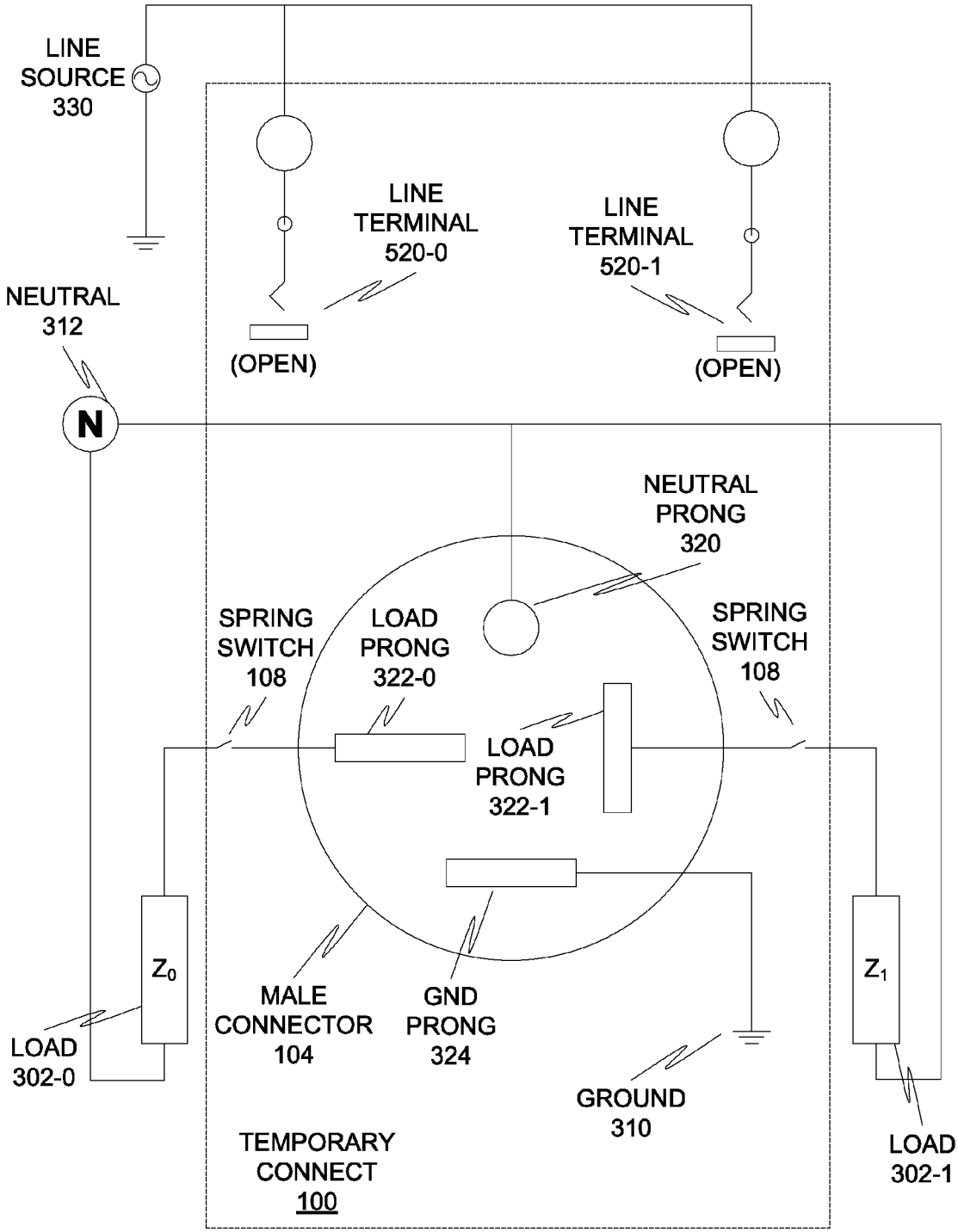
FIG. 3 is an electrical block diagram showing the connections of the electrical components.

FIG. 3 is an electrical block diagram of an exemplary embodiment of a temporary connect. Connector 104 includes a neutral prong 320, load prong 322-0 and load prong 322-1 (each providing a separate power phase), and a ground prong 324. Load prongs 322 interface with spring switch 108, so that the electrical connection is broken when the switch opens. When spring switch 108 is closed, load prong 322-0 is connected to load 302-0 ($Z_0$) and load prong 322-1 is connected to load 302-1 ($Z_1$). The mechanical interfaces for these connections are between load terminals 510 (FIG. 5) and load brackets 630 (FIG. 6). In the depicted embodiment, load prongs 322 provide 220V two-phase power, though any suitable power configuration would work. For example, with a different connector, and with an additional pair of terminals and an additional prong, three-phase power could be provided. The appropriate power configuration may depend on the design of the structure and the type of power source available.

Loads 302 have a return path through neutral node 312, which in some cases may be grounded to ground node 310. Temporary connect 100 also includes two line terminals 520, which mechanically interface with line brackets 620 (FIG. 6). Line brackets 620 (FIG. 6) provide an electrical connection to a line source 330, which may be a permanent power service connected to a power utility. In permanent operation, an electrical meter would connect loads 302 to line terminals 520, so that power is supplied to the structure from line source 330. But temporary connect 100 electrically isolates line terminals 520, so that no power is drawn from line source 330. Instead, power may be supplied by a temporary source, such as a temporary pole or a generator, through connector 104.

Figure 4:
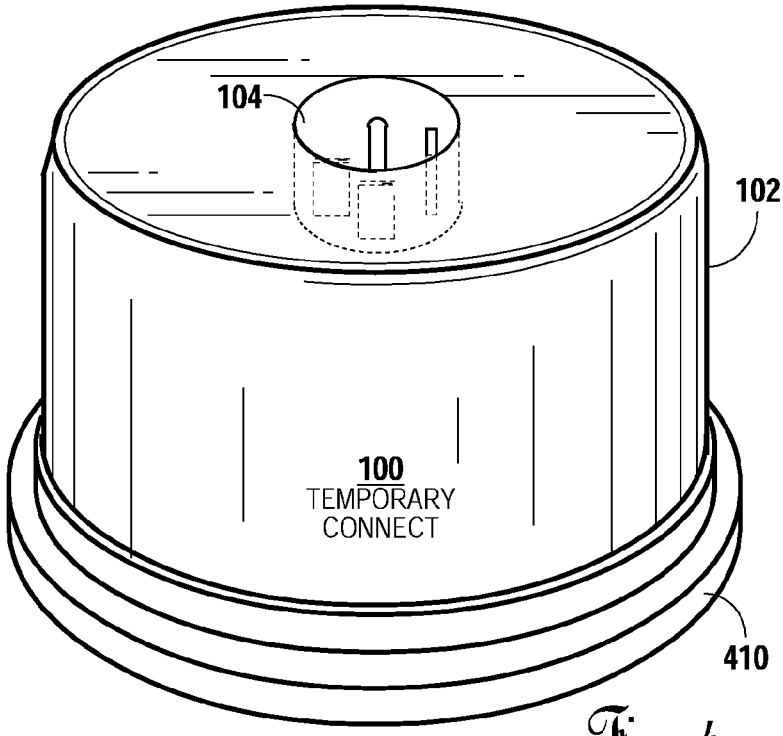
FIG. 4 is a perspective view of an exemplary form factor for a temporary connect.

FIG. 4 is a perspective view of a temporary connect 100, more particularly demonstrating the form factor, and showing that connector 104 may be recessed within base 102 with an in-use weather proof cover 105 also housing the safety switch 108. Base ring 410 is made of conductive metal, and may serve as a chassis ground point for temporary connect 100.

Figure 5:
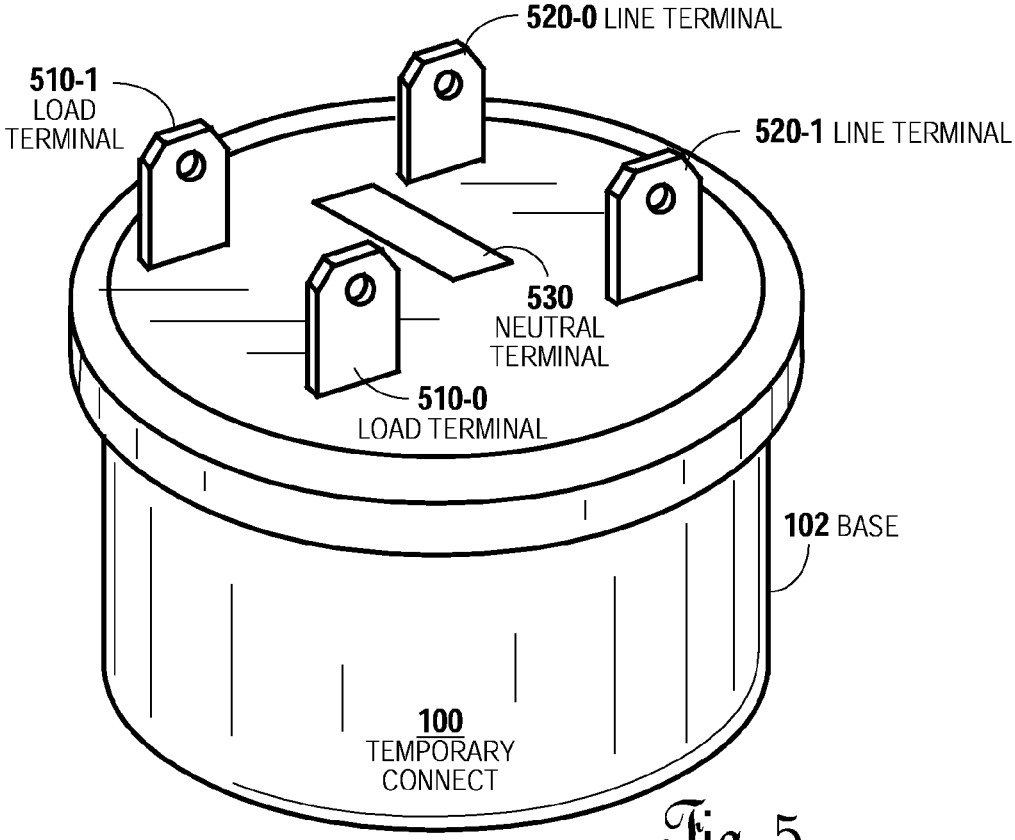
FIG. 5 is a bottom view of a base including mounting terminals and a neutral terminal.
Figure 6:
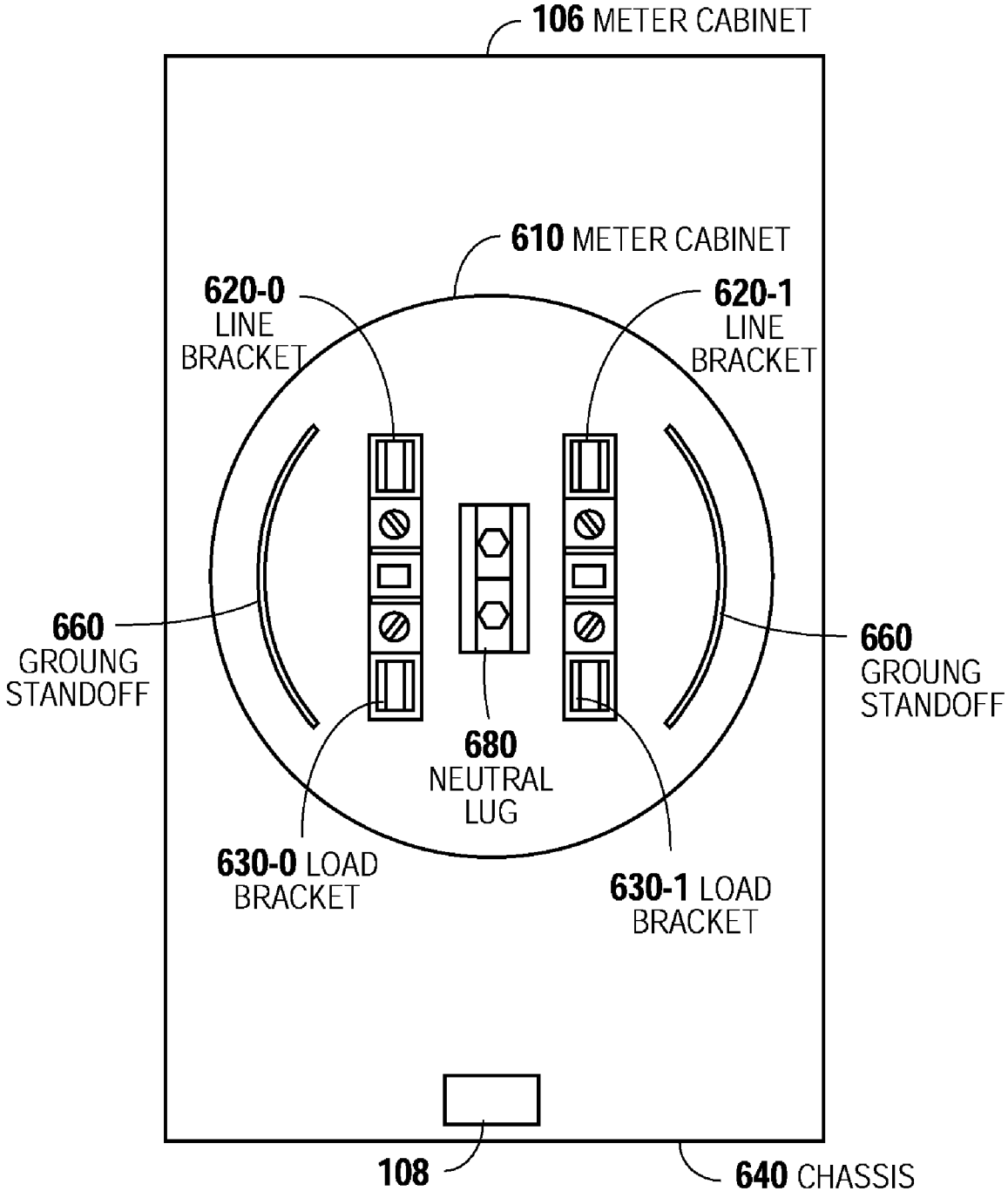
FIG. 6 is a front view of a meter cabinet usable with a temporary connect.

FIG. 5 is a perspective view of a temporary connect showing base 102. Also seen in this view are load terminals 510 and line terminals 520. Load terminals 510 may be made of a heavy-gauge conductive material, such as aluminum. Line terminals 520 may also be made of conductive material, as they commonly are in permanent electrical meters. But because one of the functions of temporary connect 100 is to isolate load terminals 510 from line terminals 520, in some embodiments, line terminals 520 may be made of a heavy-duty insulating material such as a strong plastic or composite, thus providing additional insulation. In embodiments where line terminals 520 are made of conductive material, they will, within temporary connect 100, be unconnected to the rest of temporary connect 100 and may have a coating of insulating material. Also visible in this view is neutral terminal 530, which is electrically connected to neutral node 312.

FIG. 6 is a front view of an embodiment of a meter cabinet 106 usable with a temporary connect 100. Meter cabinet 106 includes a sturdy chassis 640 for mounting to a support surface, such as a wall or electrical pole. Contained within chassis 640 is a meter socket 610 adapted to receive a temporary connect 100. Meter socket 610 includes load brackets 630 and line brackets 620. Load brackets 630 are configured to securely receive load terminals 510 (FIG. 5). Load brackets 630 are electrically connected to the site, so that when load brackets 630 are powered, the site receives power. Neutral lug 680 connects to neutral terminal 530 (FIG. 5) to provide the neutral node 312. Ground standoffs 660 are connected to ground 310, which may be an earth ground. Ground standoffs 660 are configured to electrically and mechanically couple to base ring 410.

Figure 7:
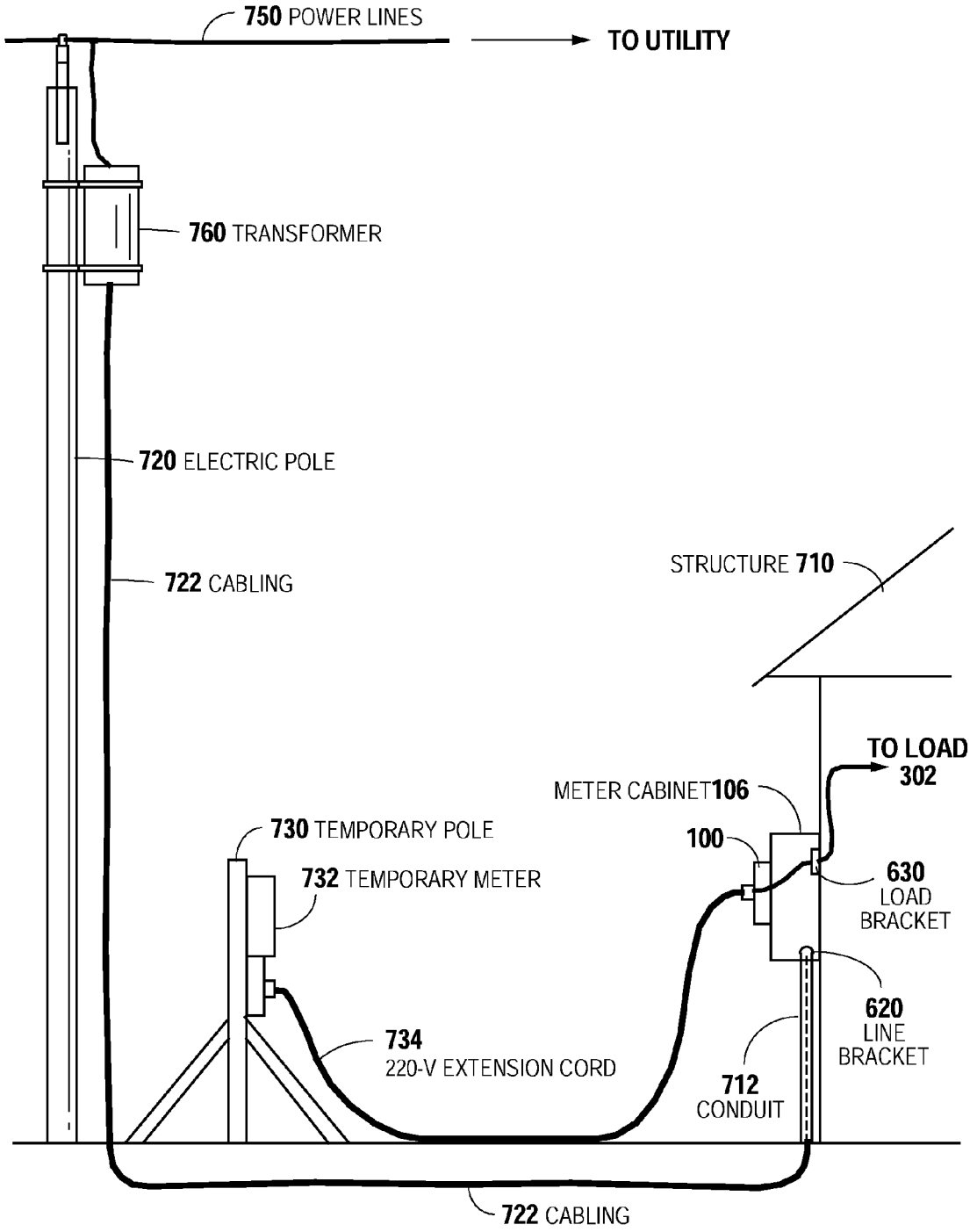
FIG. 7 is a side view of a construction site showing an exemplary application of a temporary connect.

FIG. 7 is a side view of a construction site showing an exemplary application of a temporary connect 100. A site under construction, such as a structure 710, includes load circuits 302. The site is provided with a meter cabinet 106, which may modularly receive either a temporary connect 100 or a permanent electrical meter. Load brackets 630 are connected to load 302. Line brackets 620 are connected to cabling 722, which may be protected by a conduit 712. Cabling 722 runs underground to electrical pole 720 and connects to transformer 760, which receives power from power lines 750. When construction is complete and a permanent electrical meter is installed in meter cabinet 106, power will be supplied through cabling 722. But with temporary connect 100 installed, line brackets 620 are electrically isolated from load brackets 630. Load brackets 630 are electrically connected to connector 104 (FIG. 1). A female end of 220-V extension cord 734 is plugged into male connector 104 (FIG. 1). The opposite end of extension cord 734 is plugged into an outlet at temporary meter 732, which is mounted on temporary pole 730. Temporary meter 732 may receive power from a connection to a power utility, or from another source such as a generator or battery source. As shown, power is temporarily routed from temporary meter 732 through extension cord 734 to temporary connect 100, and is thus provided to structure 710. When construction is complete, temporary connect 100 can simply be removed from meter cabinet 106 and a permanent meter can be installed in its place. The permanent meter will make the connection between load bracket 630 and line bracket 620, thus providing permanent, metered power to structure 710. Because the replacement of temporary connect 100 with a permanent electrical meter is merely a matter of unplugging one and plugging in the other, it may be able to be performed by someone other than a licensed electrician.

While the subject of this specification has been described in connection with one or more exemplary embodiments, it is not intended to limit the claims to the particular forms set forth. On the contrary, the appended claims are intended to cover such alternatives, modifications and equivalents as may be included within their spirit and scope.

What is claimed is:

1. A temporary connect for temporarily providing electrical power to a site, the temporary connect comprising:

a connector comprising at least two prongs, wherein at least one prong provides a source voltage and at least one prong provides a reference voltage; and a base providing mechanical structure and electrically coupled to the connector;

wherein the base member is configured to:

electrically couple to a meter socket comprising line brackets electrically coupled to a permanent power source, load brackets electrically coupled to electrical circuits within the site, and a reference node;

electrically couple the source voltage prong to the load brackets;

electrically couple the reference prong to the reference node; and electrically isolate the load brackets from the line brackets;

whereby power can be temporarily supplied to the site by electrically connecting the connector to a temporary power source.

2. The temporary connect of claim 1 further comprising:

a meter cabinet for holding the meter socket, the meter cabinet including a chassis for mounting to a support surface and a front panel hingedly connected to the chassis.

3. The temporary connect of claim 1 wherein the base member electrically couples to the meter cabinet via mounting terminals that also provide mechanical support.

4. The temporary connect of claim 2 further comprising:

a safety release mechanism including a biasing mechanism, the safety release mechanism having a connected state and a disconnected state, the biasing mechanism configured to bias the safety release mechanism to the disconnected state when the front panel is closed.

5. The temporary connect of claim 4 wherein the safety release mechanism is a spring-loaded switch.

6. The temporary connect of claim 4 wherein the safety release mechanism is an electronic switch.

7. The temporary connect of claim 2 wherein the temporary connect is configured to interface modularly with the meter cabinet.

8. The temporary connect of claim 7 wherein the base is modularly interchangeable with an electrical meter.

9. The temporary connect of claim 2 wherein the connector is recessed within the base member.

10. The temporary connect of claim 9 wherein the connector is a male connector.

11. The temporary connect of claim 9 further comprising a weather-proof cover over the connector.

12. The temporary connect of claim 1 wherein the connector is configured to accept a power input of at least 220 volts alternating current.

13. A temporary connect for temporarily providing electrical power to a site, the temporary connect comprising:

a connector comprising at least two prongs, wherein at least one prong provides a source voltage and at least one prong provides a reference voltage; and a base providing mechanical structure and electrically coupled to the connector;

a meter socket comprising line brackets electrically coupled to a permanent power source, load brackets electrically coupled to electrical circuits within the site, and a reference node;

a meter cabinet for holding the meter socket, the meter cabinet including a chassis for mounting to a support surface and a front panel hingedly connected to the chassis;

a safety release mechanism including a biasing mechanism, the safety release mechanism having a connected state and a disconnected state, the biasing mechanism configured to bias the safety release mechanism to the disconnected state and permit the safety release mechanism to change to the connected state when the front panel is closed;

wherein the base member is configured to:

electrically couple to the meter socket;

electrically couple the source voltage prong to the load brackets;

electrically couple the reference prong to the reference node; and electrically isolate the load brackets from the line brackets;

whereby power can be temporarily supplied to the site by electrically connecting the connector to a temporary power source.

14. The temporary connect of claim 13 wherein the safety release mechanism is a spring-loaded switch.

15. The temporary connect of claim 13 wherein the safety release mechanism is an electronic switch.

16. A temporary electrical power system for providing power to a construction site, the temporary electrical power system comprising:

a temporary connect comprising:

a mechanical housing having substantially the form factor of an electrical meter;

a base ring circumferentially engaging the mechanical housing and electrically connected to a ground node;

two line terminals configured to provide mechanical support and electrically isolated from the load node;

two conductive load terminals configured to provide mechanical support and electrically connected to a load node;

a neutral terminal electrically connected to a neutral node; and a NEMA-standard 220-V male connector configured to receive 220-V alternating current from a 220-V temporary source, the connector having at least one load prong electrically connected to the load node, a neutral prong electrically connected to the neutral node, and a ground terminal electrically connected to the ground node;

a meter socket configured to receive the temporary connect and comprising:

two line brackets configured to electrically connect to a permanent power line and configured to electrically and mechanically engage the line terminals;

two load brackets configured to electrically connect to load lines within the construction site and configured to electrically and mechanically engage the load terminals;

a neutral lug configured to electrically connect to a neutral line and configured to electrically engage the neutral terminal;

a ground standoff configured to electrically connect to a ground node and configured to mechanically and electrically couple to the base ring;

a meter cabinet for holding the meter socket, the meter cabinet including a chassis for mounting to a support surface and a front panel hingedly connected to the chassis;

a safety release mechanism including a biasing mechanism, the safety release mechanism having a connected state and a disconnected state, the biasing mechanism configured to bias the safety release mechanism to the disconnected state and permit the safety release mechanism to change to the connected state when the front panel is closed;

whereby power can be temporarily supplied to the site by electrically connecting the connector to a temporary power source.

* * * * *

UNITED STATES PATENT AND TRADEMARK OFFICE

CERTIFICATE OF CORRECTION

PATENT NO. : 7,905,748 B2
APPLICATION NO. : 12/357568
DATED : March 15, 2011
INVENTOR(S) : James Benke It is certified that error appears in the above-identified patent and that said Letters Patent is hereby corrected as shown below:

Fig. 6, change two instances of "GROUNG" to "GROUND"

Col. 3, Line 42, change "two-phase power" to "single-phase power"

Col. 5, Line 42, Claim 4, change "when the front panel is closed" to "when the front panel is open"

Signed and Sealed this
Thirty-first Day of May, 2011

David J. Kappos

David J. Kappos
*Director of the United States Patent and Trademark Office*